United States Patent [19]

Wilmotte

[11] Patent Number: 4,874,471

[45] Date of Patent: Oct. 17, 1989

[54] DEVICE FOR CASTING A METAL IN THE PASTY PHASE

[75] Inventor: Stéphan Wilmotte, Ninane, Chaud-Fontaine, Belgium

[73] Assignee: Centre de Recherches Metallurgiques-Centrum Voor Research in de Metallurgie, Brussels, Belgium

[21] Appl. No.: 126,261

[22] Filed: Nov. 27, 1987

[30] Foreign Application Priority Data

Nov. 26, 1986 [LU] Luxembourg ..... 86688
Jan. 16, 1987 [LU] Luxembourg ..... 86739

[51] Int. Cl.[4] ..... B22D 11/124

[52] U.S. Cl. ..... 164/437; 164/443; 164/122; 164/900

[58] Field of Search ..... 164/437, 439, 488, 489, 164/485, 486, 443, 444, 337, 133, 122, 900

[56] References Cited

U.S. PATENT DOCUMENTS 3,399,715 9/1968 Harders et al. ..... 164/485
3,705,672 12/1972 Saxer ..... 222/606
4,016,924 4/1977 Maier .

FOREIGN PATENT DOCUMENTS 2707774 1/1977 Fed. Rep. of Germany .
51-38237 3/1976 Japan ..... 164/133
445511 6/1975 U.S.S.R. ..... 164/437
850282 8/1981 U.S.S.R. ..... 164/443
1079347 3/1984 U.S.S.R. ..... 164/437

*Primary Examiner*—Kuang Y. Lin
*Attorney, Agent, or Firm*—Fleit, Jacobson, Cohn, Price, Holman & Stern

[57] ABSTRACT

A device for casting a metal in the pasty phase in a continuous casting mold comprises a vertical conduit disposed upstream of the mold and provided externally with cooling means a distributor member disposed substantially at the inlet of the conduit to deflect the metal flowing from a casting nozzle towards the inner surface of the vertical conduit which may be extended by a tubular element penetrating into the mold and an inlet section for the conduit at least the inner surface of which is formed by refractory material, the distributor member being disposed in the inlet section. The device may have an injector for injecting a gaseous agent into the vertical conduit below the distributor member, and a further device for causing the metal to rotate in the inlet section.

19 Claims, 4 Drawing Sheets

DEVICE FOR CASTING A METAL IN THE PASTY PHASE

BACKGROUND OF THE INVENTION

1. Field of the Invention

The present invention relates to a device for casting a metal, particularly steel, in the pasty phase in a continuous casting mould.

2. Description of the Prior Art

The advantages of the method of casting in the pasty phase, i.e. at a temperature in the solidification range of the metal in question, are already known for the continuous casting of metals such as steel. This method makes it possible to obtain fine and homogeneous structures which reduce segregations in the cast products.

BRIEF SUMMARY OF THE INVENTION

The object of the present invention is to provide a specific device which makes it possible to create the conditions needed to produce a pasty phase in the metal as it travels between the casting ladle or tundish and the continuous casting mold. The casting device of the invention may therefore be used with a casting ladle or tundish provided with a conventional nozzle.

For this purpose, the device for casting a metal in the pasty phase in a continuous casting mold, which forms the subject matter of the present invention, is essentially characterized in that it comprises a vertical conduit disposed upstream of the mold with respect to the direction of travel of the metal, in that this conduit is provided externally with cooling means, and in that a distributor member is disposed substantially at the inlet of the conduit, the distributor member being designed to deflect the metal flowing from the nozzle towards the inner surface of the vertical conduit.

In a particular embodiment of the device of the invention, the outlet end of this vertical conduit is connected to the inlet end of the mold.

In a further embodiment of the device of the invention, the vertical conduit is extended by a tubular element which penetrates into the mold.

In this case, the flow cross-section of this tubular element is at least double the outlet section of the nozzle with which the casting ladle or tundish is provided. This increased section is designed to prevent jamming by the metal which is in the pasty phase at this location.

In accordance with the invention, this conduit comprises at least one frusto-conical section converging in the direction of travel of the metal, the angle $\alpha$ of inclination of the wall of this section being no more than 45° with respect to the longitudinal axis of the conduit and preferably between 3° and 20°.

According to a further feature of the invention, the distributor member is formed by a substantially horizontal plate; the thickness of the plate decreases from its center towards its edges; its external contour is such that it provides at least one passage between the edge of the plate and the inner wall of the conduit.

According to the invention, the casting device additionally comprises a cap mounted on the inlet end of the conduit, which cap is drilled with an opening designed to allow the passage of the casting nozzle. This cap bounds a chamber located substantially above the distributor member and into which a protective gas can be introduced by appropriate means.

In operation, the device of the invention forms part of an assembly which also comprises a casting ladle or tundish provided with a nozzle and a continuous casting mold. It is disposed between the casting ladle or tundish, on the one hand, and the mold, on the other hand, such that the nozzle communicates with the inlet end of the vertical conduit, above the distributor member, and the outlet end of the vertical conduit, or of the tubular element which extends it, communicates with the continuous casting mold.

In an advantageous embodiment of the device of the invention, the vertical conduit comprises an inlet section, at least the inner surface of which is formed by a refractory material, the distributor member being disposed in this inlet section.

By means of this improved arrangement, the metal flowing from the nozzle is deflected via the distributor member towards the inner refractory wall of the inlet section. This wall is not subject to any damage caused by the heat flux applied by the metal. It may, however, undergo mechanical deterioration due to erosion in the metal impact zone.

In the context of the present invention, this erosion may be retarded by using a refractory material which has a high resistance to erosion by the liquid metal.

The erosion of the refractory section may also be retarded by a further means of the invention wherein the distributor member may be displaced vertically in translation. It is thus possible to modify the vertical position of the distributor member with respect to the refractory inlet section, either between two successive casting operations or even during a casting operation. This feature makes it possible to distribute the erosion over at least part of the axial length of the refractory inlet section and consequently to extend its service life.

In all cases, the liquid metal deflected by the distributor member flows, without substantial cooling, along the lower portion of the refractory inlet section and then along the copper section where it undergoes the desired cooling.

According to an advantageous characteristic feature, the device of the invention comprises means for injecting a gaseous agent into the vertical conduit, below the distributor member.

These means are advantageously formed by at least one injector mounted on the lower face of the distributor member and connected to an appropriate source of a gaseous agent, the latter preferably being an inert gas such as argon.

The gaseous agent injected in this way makes it possible to re-establish the pressure below the distributor member and consequently ensures that the thin layer of metal is correctly applied to the inner wall of the vertical conduit.

According to a further advantageous characteristic feature, an element of the vertical conduit, for example the inlet section of refractory material or even the frusto-conical element is provided with means designed to cause the metal passing through the section to move in rotation.

These means are advantageously formed by inductors generating a rotary electromagnetic field.

BRIEF DESCRIPTION OF THE DRAWINGS

A preferred embodiment of the invention is described in further detail below with reference to the accompanying drawings, wherein.

DETAILED DESCRIPTION

Figure 1:
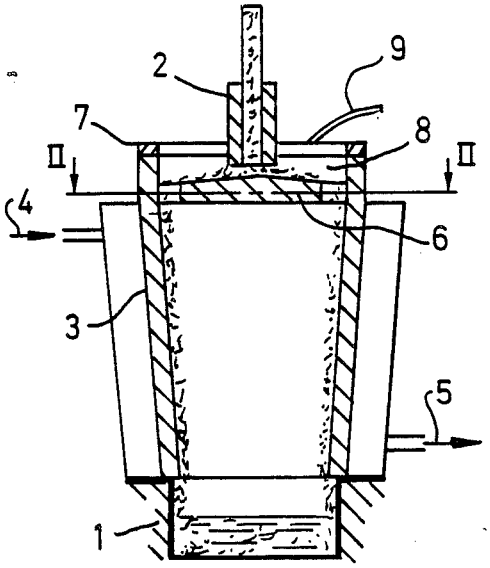
FIG. 1 is cross-sectional view of a casting device of the invention taken along the line I—I of FIG. 2.

In the figures, corresponding components have been designated by the same reference numerals.

Figure 2:
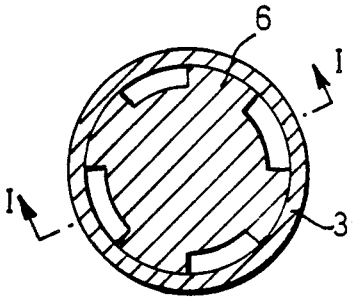
FIG. 2 is a cross-sectional view of the casting device of FIG. 1 taken along line II—II thereof.

FIG. 1 shows, in cross-section, a casting device of the invention, disposed between a continuous casting mold 1 and a casting ladle or tundish illustrated by the nozzle 2. A frusto-conical copper conduit 3 is mounted on the mold 1; this conduit is provided with water cooling shown diagrammatically by the arrows 4 and 5. A distributor member in the form of a plate 6 whose thickness decreases from its center to its edges is disposed at the upper end of this conduit 3. The shape of the plate is adapted to the shape of the cross-section of the conduit 3. FIG. 2 shows a plate whose edge bears four projections ensuring the centering of the plate in the conduit, and providing peripheral passages between the projections.

The distributor plate may be axially displaceable in the inlet portion of the conduit to compensate for erosion by distributing the erosion over at least part of the axial length of the inlet portion as described above.

Returning to FIG. 1, the conduit 3 is provided with a cap 7 bounding a chamber 8 above the distributor plate 6. This cap 7 is provided with an opening in which the nozzle 2 engages; the cap 7 is also provided with a system 9 for introducing a pressurized gas into the chamber 8. A system for introducing gas of this type is well known and is not described in detail here.

Figure 3:
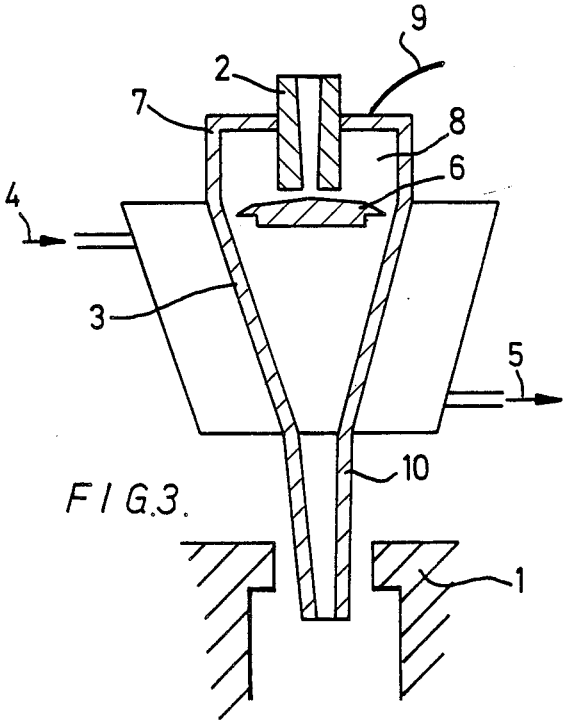
FIG. 3 is a view similar to FIG. 1 of a different embodiment of the invention in which the vertical conduit is extended by a tubular element penetrating into the continuous casting mold.

FIG. 3 shows a variant of the device of the invention, in which the vertical conduit 3 is extended by a tubular element 10 penetrating into the mold 1. If necessary, the lower end of this tubular element 10 may be immersed in the pasty metal located in the mold. The remainder of this variant corresponds completely to the embodiment of FIG. 1.

Figure 4:
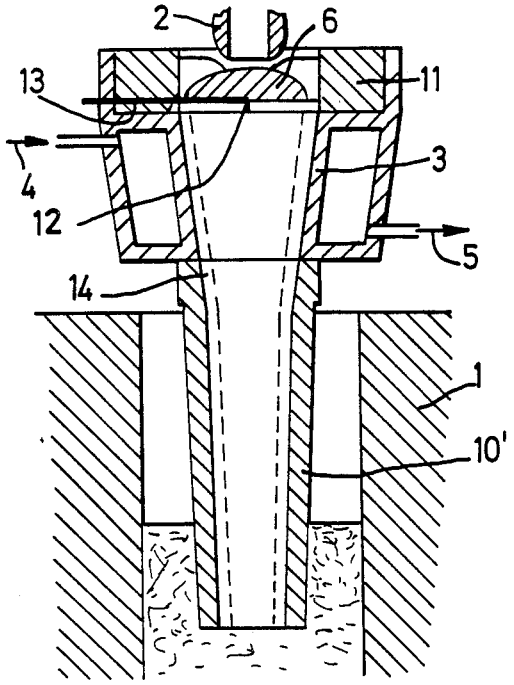
FIG. 4 is a view similar to FIG. 1 of a further embodiment of the invention having an inlet section of refractory material, and a system for injecting a gaseous agent.

FIG. 4 shows a casting device comprising a vertical conduit 3 provided externally with a cooling circuit 4, 5, and a distributor member 6 disposed in this vertical conduit.

The vertical conduit 3 is extended by a tubular element 10 which penetrates into the continuous casting mold 1, while the distributor element 6 is disposed below a nozzle 2 provided on a casting container (not shown). The vertical conduit 3 comprises an inlet section 11 of refractory material, within which the distributor member 6 is disposed. The latter is also provided with an injector 12 connected by piping 13 to a source of gaseous agent (not shown). The gaseous agent injected by the injector 12 forms, within the vertical conduit, a pocket of gas which applies the thin layer of metal 14 to the inner surface of this vertical conduit.

Figure 5:
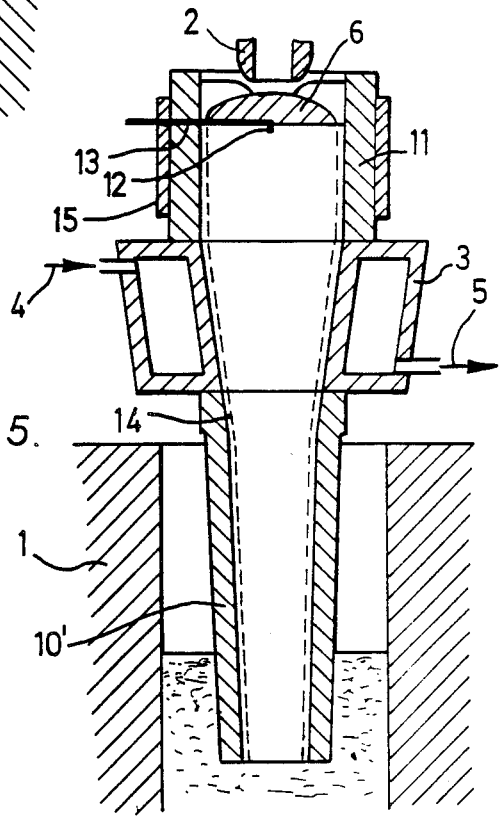
FIG. 5 is a view of a further embodiment similar to that of FIG. 4 and further comprising inductors disposed around the inlet section.

The device shown in FIG. 5 is essentially identical to that of FIG. 4. It differs solely in that the inlet section 11 of refractory material has a greater axial length and in that it is surrounded by inductors 15. These inductors generate a rotary electromagnetic field which causes the metal to rotate in the inlet section 11 thereby ensuring the correct distribution of the liquid metal on the periphery of the inlet section. The resultant centrifuge effect is also added to the action of the gaseous agent injected by the injector 12 to ensure that the thin layer of metal 14 is applied to the inner wall of the inlet section 11. The metal 14 is therefore caused to rotate before entering the copper cooling section of the vertical conduit 3.

The device operates as follows.

The conduit 3 is mounted on the mold 1 and the distributor plate 6 and the cap 7 are then fitted in turn. The casting ladle or tundish (not shown) is then brought into position such that it engages the nozzle 2 in the opening provided in the cap 7. The nozzle 2 is opened and the superheated liquid steel flows through the nozzle onto the distributor plate 6. As a result of the inclination of the upper surface of the plate 6, the steel flows towards the periphery of the plate 6, then through the passages provided between the centering projections of the plate.

The liquid steel thus flows in a thin layer and is spread over the inner wall of the conduit 3. The cooling of the conduit eliminates the superheat from the steel and causes the appearance of a solid fraction which makes the steel pasty at its inlet into the mold 1. The introduction of a pressurized protective gas, for example argon, into the chamber 8 causes an overpressure in this chamber and prevents any air which has entered from coming into contact with the liquid steel.

By way of example, blooms with a section of 220 mm×220 mm, of steel containing 0.7% C were cast at a rate of flow of 20 t/h. The initial superheating of the steel was 25° C.; the temperature of the steel in the nozzle was 1505° C. The steel was cast on a distributor plate of refractory material, under protective argon, then along the inner walls of the conduit 3. The latter was formed by a frusto-conical copper conduit, with a length of 350 mm and a diameter of 220 mm midway; the angle of inclination $\alpha$ of the wall of the frustum of the cone was 5° with respect to vertical.

The conduit was cooled by water circulating at high speed providing an average cooling flux density of 3 MW/m2. The heat reflux eliminated was 72 MW and led to a solid fraction of 38% by volume in the steel entering the mold.

The device of the invention has a considerable heat exchange surface between the cooled conduit and the liquid steel; the high speed of flow of the latter along the wall of the conduit makes it possible to obtain a high heat reflux density. It would not, moreover, lie outside of the scope of the invention to increase this flux density by causing the conduit to rotate about its axis.

The device of the invention is simple, compact and strong. It is very reliable in operation, particularly as there is a very low risk of jamming.

I claim:

1. A device for continuously casting a metal in the pasty phase in a continuous casting mold comprising:

a casting nozzle having an outlet;

a vertical conduit disposed upstream of the mold with respect to the direction of travel of the metal from the casting nozzle, said conduit having an inlet, an outlet, and an inner surface extending between said conduit inlet and outlet;

said conduit comprising, an inlet section adjacent said inlet, an inner surface formed of refractory material on said inlet section, and a downstream section disposed downstream of said inlet section;

cooling means for cooling said downstream section of said conduit externally of said inner surface thereof;

a distributor member disposed in said inlet section of said conduit having a surface in closely spaced relationship to said nozzle outlet for receiving metal poured thereon from said nozzle outlet, said distributor surface extending transversely with respect to said conduit inlet section a sufficient distance for discharging the metal directly against said inner surface of said inlet section; and means for injecting a gaseous agent into said conduit at a position downstream of and adjacent to said distributor member for producing a gas pocket within said conduit for urging the metal against said inner surface of said conduit.

2. The device as claimed in claim 1 and further comprising:

a tubular extension on said vertical conduit penetrating into the mold.

3. The device as claimed in claim 1 wherein:

said conduit comprises at least one frusto-conical section converging in the direction of travel of the metal at an angle no greater than 45° with respect to the vertical.

4. The device as claimed in claim 3 wherein:

said angle is between 3° and 20°.

5. The device as claimed in claim 1 wherein said distributor member comprises:

a substantially horizontal plate shaped member having a thickness which decreases from the central portion of the peripheral portion thereof; and a peripheral contour on said plate shaped member that provides at least one passage between the periphery thereof and said inner surface of said conduit for the flow of metal therethrough.

6. The device as claimed in claim 1 and further comprising:

a cap mounted on said inlet of said conduit; and an opening in said cap for receiving said casting nozzle therein.

7. The device as claimed in claim 1 wherein:

said distributor member is vertically displaceable in said inlet section of said conduit.

8. The device as claimed in claim 1 and further comprising:

means for rotating the metal passing through said vertical conduit.

9. The device as claimed in claim 8 wherein:

said means for rotating the metal comprises inductor means for generating a rotary electromagnetic field.

10. The device as claimed in claim 9 wherein:

said inductor means is disposed around said inlet section of said conduit for producing a centrifuge effect urging the metal against said inner surface of said conduit.

11. The device as claimed in claim 1 wherein:

said downstream section comprises a frusto-conical copper conduit.

12. The device as claimed in claim 11 wherein:

said cooling means comprises water cooling means surrounding said downstream section.

13. The device as claimed in claim 12 wherein said distributor member comprises:

a substantially horizontal plate shaped member having a thickness which decreases from the central portion to the peripheral portion thereof; and a peripheral contour on said plate shaped member that provides at least one passage between the periphery thereof and said inner surface of said conduit for the flow of metal therethrough.

14. The device as claimed in claim 13 wherein:

said distributor member is vertically displaceable in said inlet section of said conduit.

15. The device as claimed in claim 14 and further comprising:

means for injecting a gaseous agent into said conduit at a position downstream of said distributor member for producing a gas pocket within said conduit for urging the metal against said inner surface of said conduit.

16. The device as claimed in claim 1 and further comprising:

means for rotating the metal passing through said vertical conduit.

17. The device as claimed in claim 15 and further comprising:

means for rotating the metal passing through said vertical conduit.

18. The device as claimed in claim 16 wherein:

said means for rotating the metal comprises inductor means for generating a rotary electromagnetic field.

19. The device as claimed in claim 18 wherein:

said inductor means is disposed around said inlet section of said conduit for producing a centrifuge effect urging the metal against said inner surface of said conduit.

* * * * *